United States Patent [19]

Bainbridge

[11] Patent Number: 4,664,000

[45] Date of Patent: May 12, 1987

[54] LOCKNUT KEY AND MOUNTING STRUCTURE THEREFOR

[75] Inventor: Gary R. Bainbridge, North Tonawanda, N.Y.

[73] Assignee: McGard, Inc., Buffalo, N.Y.

[21] Appl. No.: 754,745

[22] Filed: Jul. 15, 1985

[51] Int. Cl.[4] ..... B25B 13/02; B25B 23/08

[52] U.S. Cl. ..... 81/451; 81/176.15; 81/121.1

[58] Field of Search ..... 81/121.1, 124.7, 451, 81/461, 180.1, 176.15; 76/114; 7/100

[56] References Cited

U.S. PATENT DOCUMENTS

| | | | |
|---|---|---|---|
| 2,263,277 | 11/1941 | Schumann | 81/121.1 X |
| 2,457,451 | 12/1948 | Domack | 76/114 |
| 3,241,408 | 3/1966 | McCauley | 81/461 |
| 4,038,757 | 8/1977 | Hicks et al. | 81/451 X |
| 4,285,255 | 8/1981 | Winfrey | 81/451 |

FOREIGN PATENT DOCUMENTS

| | | | |
|---|---|---|---|
| 881129 | 6/1953 | Fed. Rep. of Germany | 81/461 |
| 845915 | 9/1939 | France | 81/176.15 |

*Primary Examiner*—Frederick R. Schmidt
*Assistant Examiner*—Debra S. Meislin
*Attorney, Agent, or Firm*—Joseph P. Gastel

[57] ABSTRACT

A locknut key including a key body, a key shroud mounted on the key body and a key member mounted on the key body within the shroud, the shroud extending for a substantial distance beyond the key to guide the key over the outer surface of a locknut which is to be turned by the key. A wrench-locknut key combination including a wrench having a shank, a U-shaped spring clip secured to the shank, a groove on the locknut key for receiving the U-shaped spring clip, and an elongated tie member for attaching the locknut key to the spring member.

13 Claims, 10 Drawing Figures

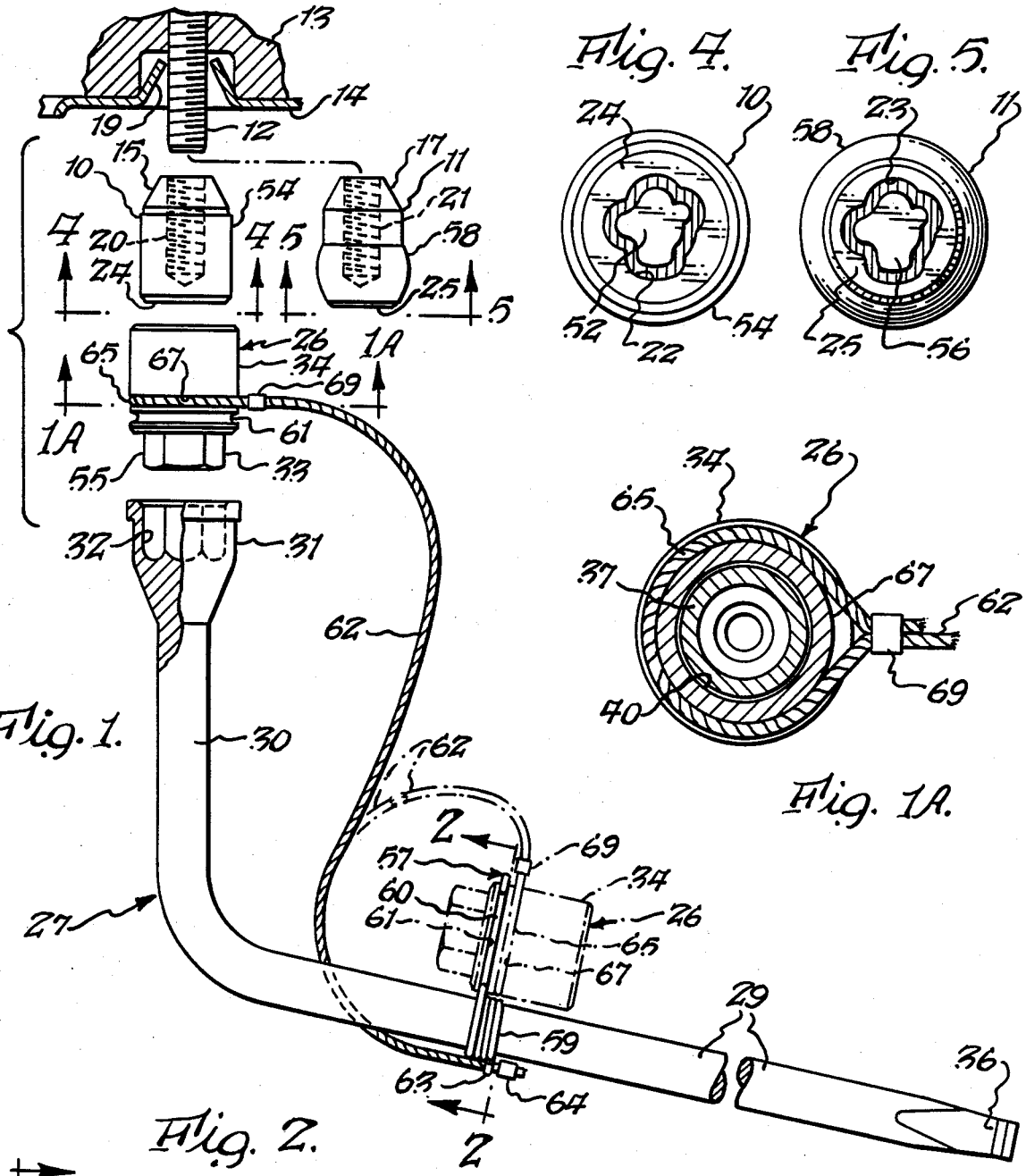
Fig. 1.
Fig. 4.
Fig. 5.
Fig. 1A.
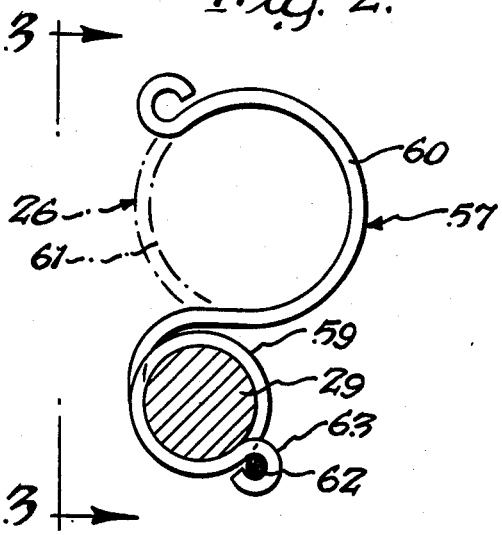
Fig. 2.
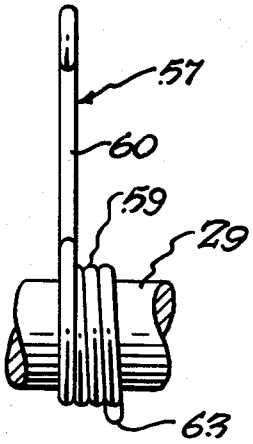
Fig. 3.

LOCKNUT KEY AND MOUNTING STRUCTURE THEREFOR

BACKGROUND OF THE INVENTION

The present invention relates to an improved locknut key construction and to a wrench-locknut key combination.

By way of background, there are in common use locknuts for securing an automotive wheel rim to an axle to prevent unauthorized removal therefrom. These locknuts have an endless curvilinear groove which receives a ridge of a mating key for tightening and loosening the locknut. Locknuts and keys of the foregoing type are disclosed in U.S. Pat. No. 3,241,408. In the past, precise manipulation was required to insert the curvilinear ridge of the key into its mating curvilinear groove in the locknut. In addition, a balanced force had to be applied to the locknut key to maintain the curvilinear ridge in good mating relationship with its associated groove, or the possibility existed that the two could lose contact. It is with overcoming the foregoing deficiencies of prior constructions that the present invention is concerned.

SUMMARY OF THE INVENTION

It is one object of the present invention to provide an improved locknut key construction which centers the ridge on the locknut key relative to the locknut groove so that the two can be mated by merely turning the key relative to the locknut.

Another object of the present invention is to provide an improved locknut key having a shroud which fits over the locknut body during the mounting operation to not only center the ridge of the locknut key relative to the locknut groove but to also stabilize the locknut key on the locknut so that an uncentered turning force can be applied to the locknut.

Another object of the present invention is to provide an improved wrench-locknut key combination wherein the locknut key is secured to the wrench in an extremely simple and expedient manner.

Yet another object of the present invention is to provide an improved locknut key fabricated from a plurality of parts which can be assembled in an extremely simple and expedient manner. Other objects and attendant advantages of the present invention will readily be perceived hereafter.

The present invention relates to a locknut key construction comprising a key body having first and second key body ends and a central portion therebetween, nut means on said first key body end, a locknut shroud having first and second shroud ends, first mounting means mounting said first shroud end on said central portion, a key having first and second key ends, second mounting means mounting said first key end on said second key body end within said locknut shroud with said second shroud end extending beyond said second key end, and key means on said second key end.

The present invention also relates to a wrenchlocknut key combination comprising a wrench having a shank and a socket mounted thereon; a locknut key having an outer surface with a pair of spaced annular grooves therein; and a clip including a U-shaped spring member; mounting means mounting said clip on said shank with said U-shaped spring member in position to receive one of said annular grooves therein, a flexible tie member having first and second tie ends, first securing means for securing said first tie end to said clip, and second securing means for securing said second tie end in said second groove, said tie member being of a sufficient length so that said locknut key can be received in said socket after being demounted from said U-shaped spring member.

The various aspects of the present invention will be more fully understood when the following portions of the specification are read in conjunction with the accompanying drawings wherein:

BRIEF DESCRIPTION OF THE DRAWINGS

FIG. 1 is a fragmentary exploded side elevational view partially in cross section showing the combination of an L-handle lug wrench with its associated locknut key and various types of locknuts which are shown relative to a wheel rim mounted on an axle-carried stud;

FIG. 1A is a cross sectional view taken substantially along line 1A—1A of FIG. 1;

FIG. 2 is a view taken substantially in the direction of arrows 2—2 of FIG. 1 and showing the configuration of the spring clip used to mount the locknut key on the handle of the L-handle wrench;

FIG. 3 is a side elevational view of the spring clip taken substantially in the direction of arrows 3—3 of FIG. 2;

FIG. 4 is a view taken substantially in the direction of arrows 4—4 of FIG. 1, and showing the key-receiving groove in the end of one type of locknut;

FIG. 5 is a view taken substantially in the direction of arrows 5—5 of FIG. 1 and showing the key-receiving groove in the end of another type of locknut;

DESCRIPTION OF THE PREFERRED EMBODIMENTS

Figure 7:
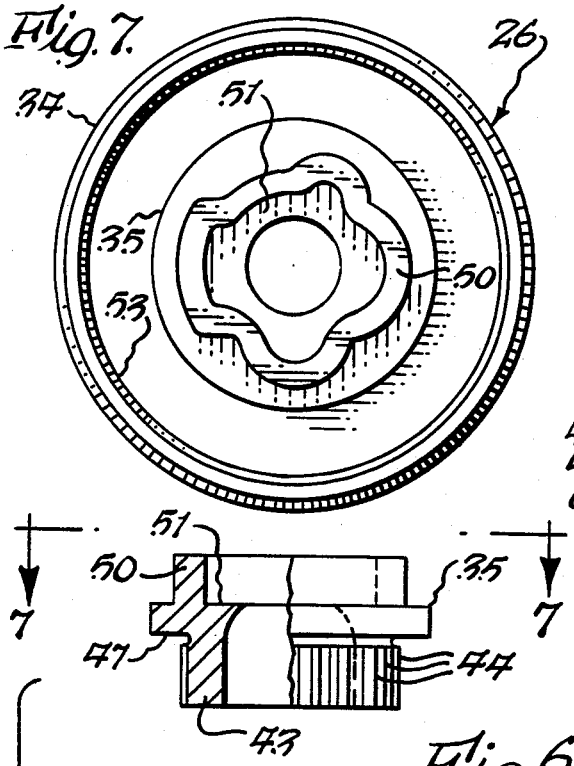
FIG. 7 is a view taken substantially in the direction of arrows 7—7 of FIG. 6 and showing the end of the key portion of the locknut key.
Figure 9:
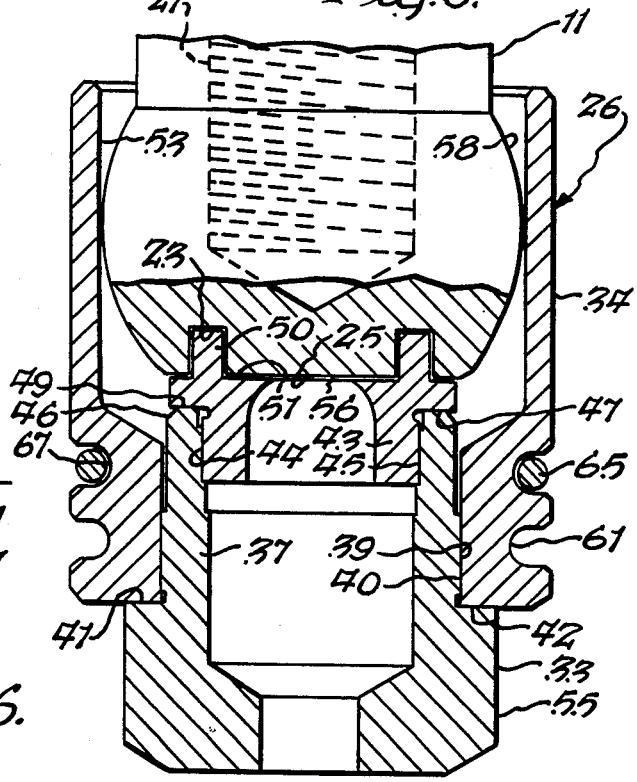
FIG. 9 is a view similar to FIG. 8 and showing the locknut key mounted on the end of another type of locknut.
Figure 6:
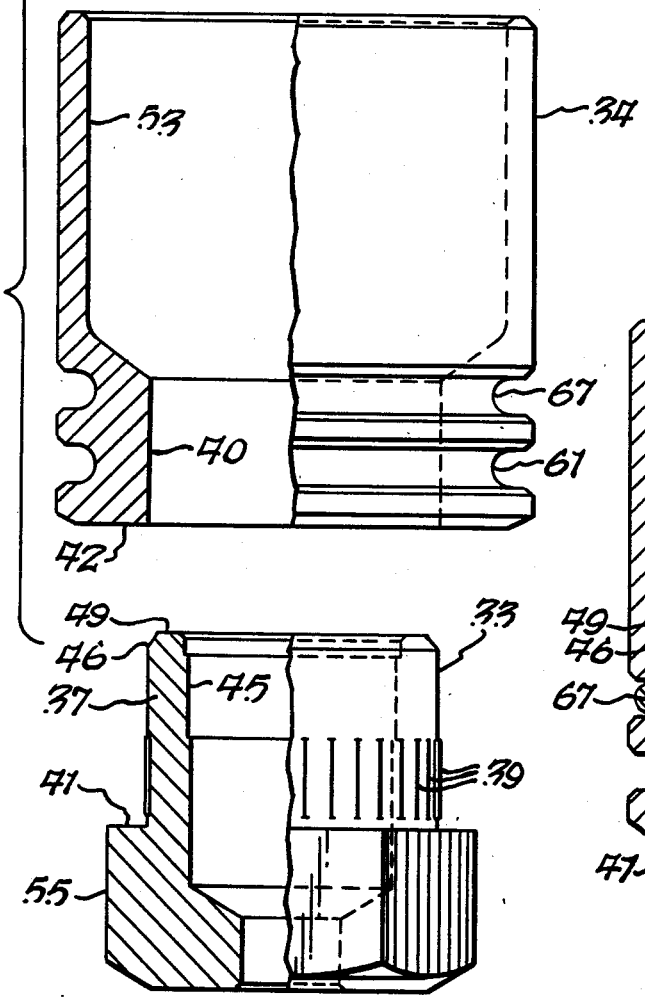
FIG. 6 is an exploded view, partially in side elevation, and partially in cross section of the three components of the locknut key.

Locknuts, such as 10 and 11, may be threadably mounted on a stud, such as 12, which is carried by axle 13 of an automotive vehicle for mounting a wheel rim 14. The locknuts require a special key to thereby prevent unauthorized removal of rim 14. Locknuts of the foregoing general type are generally described in U.S. Pat. No. 3,241,408. In mounted position, the noses 15 and 17 of locknuts 10 and 11, respectively, bear against frustoconical annular portion 19 of rim 14. Locknuts 10 and 11 also include internally threaded portions 20 and 21, respectively, which thread onto threaded stud 12. Locknuts 10 and 11 include grooves 22 and 23, respectively, in their ends 24 and 25, respectively, for receiving a key of mating configuration to unscrew a nut from stud 12. It will be appreciated that either locknut 10 or locknut 11 can be mounted on the stud 12, and further that locknuts 10 and 11 are representative of numerous different types of locknuts which are used.

The improved locknut key 26 of the present invention enables locknuts, such as 10 and 11, to be removed by the use of an L-handle lug wrench 27 which has a shank 29 which includes a portion 30 which mounts a socket 31 having a hexagonal depression 32 therein. A prying tip 36, of the type used to pry a wheel cover from its associated rim, is located at the opposite end of shank 29. The reason an L-handle wrench 27 can be used is because the locknut key 26 provides an extremely stable connection between the head 31 of wrench 27 and a locknut, such as 10 and 11, so that there will be no slippage of locknut key 26 from mounted relationship on locknuts.

The locknut key 26 is an assembly of three component parts, namely, a key body 33, a locknut shroud 34 and a key 35. Locknut body 33 includes a central portion 37 having splines 39 which are received in bore 40 of locknut shroud 34 when the two are pressed together with a press-fit. In its assembled relationship with shroud 34, annular shoulder 41 of key body 33 bears against annular shoulder 42 of shroud 34. Key 35 has an end 43 with splines 44 thereon press-fitted into bore 45 at end 46 of key body 33. An annular shoulder 47 of key 35 bears against end 49 of key body 33. A ridge 50 of the configuration shown in FIG. 7 is formed at the end of key 35 for mating insertion into grooves, such as 22 and 23 of nuts 10 and 11, respectively. A base 51 is located within the confines of ridge 50 and when key 35 is in assembled relationship with the associated nut 10 or 11, islands 52 or 56, respectively, within grooves 22 or 23, respectively, of nuts 10 or 11, respectively, will be received within the irregular confines of ridge 50 and will sit firmly on base 51.

Figure 8:
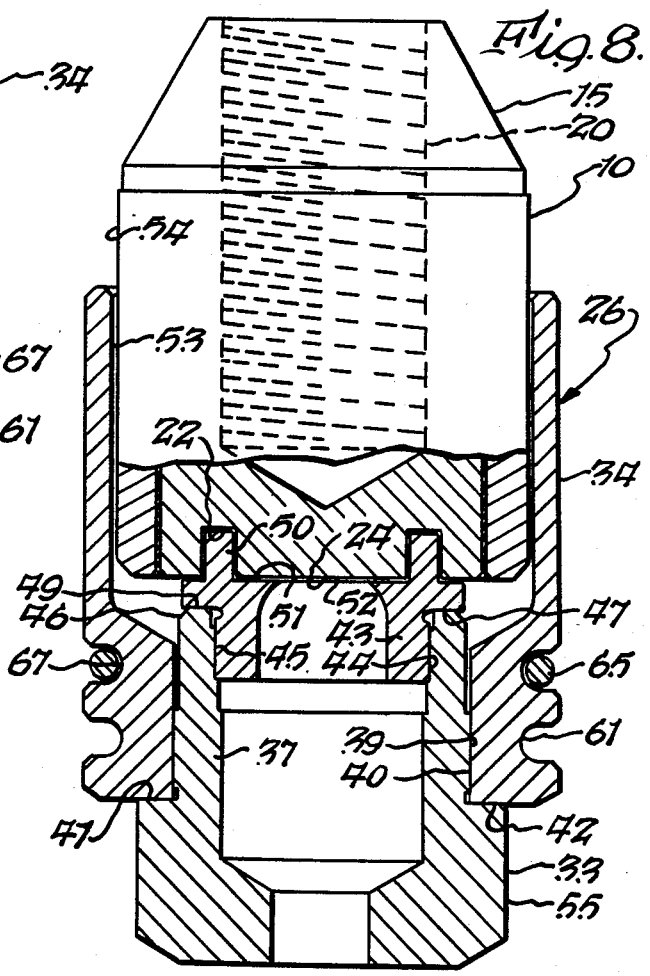
FIG. 8 is a side elevational view, partially in cross section, showing the locknut key in assembled relationship and mounted on the end of one type of locknut.

Key shroud 34 includes an internal cylindrical cavity 53 which receives either the outer surface 54 of nut 10 or the outer surface 58 of nut 11. As can be seen from FIG. 8, when locknut key 26 is used with nut 10, the internal cylindrical surface 53 fits closely over outer cylindrical surface 54 of nut 10. This centers locknut key 26 relative to locknut 10 so that the mere rotation of locknut key 26 relative to locknut 10 will result in ridge 50 falling into endless curvilinear groove 22. In other words, ridge 50 and groove 22 are on the same centerline, so that when locknut key shroud 34 is placed over locknut surface 54, the centers of ridge 50 and groove 22 are aligned. Furthermore, the closeness of the fit between internal cylindrical surface 53 of shroud 34 and cylindrical surface 54 of the locknut prevents ridge 50 from cocking out of engagement with groove 22. This is especially important when it is considered that when the hexagonal opening 32 of wrench socket 31 is placed over hexagonal nut 55 of locknut body 33 and an offcenter force is applied to wrench shank or handle 29, such an offcenter force will be incapable of moving ridge 50 out of groove 22 because of the bearing relationship between internal shroud surface 53 and external nut surface 54.

The same general relationship discussed above relative to FIG. 8 also applies between the internal cylindrical surface 53 of locknut key 26 and the external spherical surface 58 of locknut 11. In this respect, it can be seen that there is a bearing relationship between the closest portions of surfaces 53 and 58 for stabilizing locknut key 26 against cocking to the extent wherein there is a loss of engagement between ridge 50 and groove 23.

In order to prevent loss of locknut key 26, it is secured to and mounted on the shank of L-handle wrench 27 by a spring clip 57. More specifically, spring clip 57 is made of spring metal and it includes a coiled spring portion 59 which merges into a U-shaped clip portion 60. Coiled spring portion 59 is firmly mounted on shank 29 and is maintained in position thereon by the biasing force which it exerts. In order to mount coiled spring portion 59 on shank 29, it is forced to a more open condition by applying an opening force which opposes its normal biasing force and is slipped onto shank 29. When the opening force is removed, it will spring back to its original shape wherein it clamps itself onto shank 29. U-shaped portion 60 is normally of a slightly smaller diameter than annular groove 61 in key shroud 34. Therefore, the locknut key 26 can be mounted on spring clip 57 by forcing groove 61 into spring clip 57. The foregoing structure thus retains locknut key 26 in mounted position on shank 29 when wrench 27 is not being used.

In order to prevent the loss of locknut key 26 when it is demounted from spring clip 57, an elongated tie member 62 fastens them together. Tie member 62 is a metal cable having an end which fits through loop 63 at the end of coil spring portion 59. An enlarged member 64 is pressed onto the end of tie member 62 to prevent it from slipping out of loop 63. The opposite end of tie member 62 is formed into a loop 65 which is rotatably received in annular groove 67 of shroud 34 and a locking member 69 locks the loop in position. Thus, locknut key 26 is firmly tied to shank 29 both when it is received in U-shaped portion 60 and when it is removed therefrom to mount on a nut, such as 10 or 11. Tie member 62 is sufficiently long so that hexagonal cavity 32 of socket 31 can fit on hexagonal nut portion 55 of body member 33.

It can thus be seen that the improved locknut key construction and wrench-locknut key combination are manifestly capable of achieving the above enumerated objects and while preferred embodiments of the present invention have been disclosed, it will be appreciated that it is not limited thereto but may be otherwise embodied within the scope of the following claims.

What is claimed is:

1. A wrench-locknut key combination comprising a wrench having a shank and a socket mounted thereon; a locknut key having an outer surface with a pair of spaced annular grooves therein; and a clip including a U-shaped spring member; mounting means mounting said clip on said shank with said U-shaped spring member in position to receive one of said annular grooves therein, a flexible tie member having first and second tie ends, first securing means for securing said first tie end to said clip, and second securing means for securing said second tie end in said second groove, said tie member being of a sufficient length so that said locknut key can be received in said socket after being demounted from said U-shaped spring member.

2. A wrench-locknut key combination as set forth in claim 1 wherein said mounting means comprises a coiled spring portion which is a continuation of said U-shaped spring member.

3. A wrench-locknut key combination as set forth in claim 2 wherein said second securing means comprises a loop at the end of said coiled spring portion.

4. A locknut key construction comprising a key body having first and second key body ends and a central portion therebetween, nut means formed integrally with said key body and located on said first key body end, a locknut shroud having first and second shroud ends, a first bore located in said first shroud end, a first press fit rigidly and fixedly mounting said central portion of said key body in said first bore, a key having first and second key ends, a second bore in said second key body end, a second press fit between said second key body end and said first key end rigidly mounting said first key end in said second bore of said second key body end, said second key end being located within said locknut shroud with said second shroud end extending beyond said second key end, and key means on said second key end.

5. A locknut key construction comprising a key body having first and second key body ends and a central portion therebetween, nut means on said first key body end, a locknut shroud having first and second shroud ends, first mounting means mounting said first shroud end on said central portion, a key having first and second key ends, second mounting means mounting said first key end on said second key body end within said locknut shroud with said second shroud end extending beyond said second key end, key means on said second key end, a first annular groove in said locknut shroud for receiving a spring clip, and a second annular groove in said locknut shroud spaced from said first annular groove for receiving a tie member.

6. A locknut key construction as set forth in claim 4 wherein said key means comprises an endless curvilinear ridge, and wherein said shroud is a sleeve having an internal cylindrical surface for effecting a close fit with the outer surface of a nut having a groove for mating engagement with said endless curvilinear ridge.

7. A locknut key construction as set forth in claim 5 wherein said annular grooves are located proximate said first shroud end.

8. A locknut key construction as set forth in claim 5 including a bore at said first shroud end, and wherein said first mounting means comprises a press-fit between said central portion of said key body and said bore at said first shroud end.

9. A locknut key construction as set forth in claim 8 including a second bore in said second key body end, and wherein said second mounting means comprises a second press-fit between said bore at said second key body end and said first key end.

10. A locknut key construction as set forth in claim 4 wherein said first press-fit includes first splines, and wherein said second press-fit includes second splines.

11. A locknut key construction as set forth in claim 10 wherein said first splines are on said central portion, and wherein said second splines are on said key.

12. A locknut key construction as set forth in claim 8 wherein said press-fit includes splines on said central portion of said key body.

13. A locknut key construction as set forth in claim 12 including a second bore in said second key body end, and wherein said second mounting means comprises a second press-fit between said bore at said second key body end and said first key end, said second press-fit including second splines on said key.

* * * * *